United States Patent [19]

Lindstrom

[11] Patent Number: 5,039,285

[45] Date of Patent: Aug. 13, 1991

[54] LUBRICATION SYSTEM OF CONNECTING ROD, PISTON, AND WRIST PIN FOR A COMPRESSOR

[75] Inventor: Robert A. Lindstrom, Tecumseh, Mich.

[73] Assignee: Tecumseh Products Company, Tecumseh, Mich.

[21] Appl. No.: 466,754

[22] Filed: Jan. 18, 1990

[51] Int. Cl.[5] ..... F04B 39/06

[52] U.S. Cl. ..... 417/368; 184/6.8; 92/157

[58] Field of Search ..... 92/157; 184/6.5, 6.8; 417/368

[56] References Cited

U.S. PATENT DOCUMENTS

| | | | |
|---|---|---|---|
| 895,755 | 12/1907 | Hedstrom . | |
| 1,307,454 | 6/1919 | Pittman et al. . | |
| 1,437,927 | 12/1922 | Brockway . | |
| 1,558,978 | 10/1925 | Grimes . | |
| 1,839,680 | 1/1932 | Hudson . | |
| 1,878,574 | 9/1932 | Blundell | 92/157 |
| 2,040,507 | 5/1936 | Terry . | |
| 2,232,170 | 2/1941 | Eynon . | |
| 2,437,824 | 3/1948 | Kishline | 92/157 |
| 2,456,668 | 9/1948 | Anderson . | |
| 2,752,088 | 5/1952 | Borgerd et al. . | |
| 2,956,730 | 10/1960 | Hamilton | 417/372 |
| 3,069,926 | 12/1962 | Hoffman et al. . | |
| 3,131,785 | 5/1964 | Blank . | |
| 3,279,683 | 10/1966 | Kleinlein . | |
| 3,431,796 | 3/1969 | Valbjorn . | |
| 3,482,467 | 12/1969 | Volkel . | |
| 3,730,020 | 5/1973 | DiMatteo, Sr. et al. . | |

FOREIGN PATENT DOCUMENTS

| | | |
|---|---|---|
| 8504926 | 5/1987 | Brazil . |

*Primary Examiner*—Leonard E. Smith
*Assistant Examiner*—Michael I. Kocharov
*Attorney, Agent, or Firm*—Jeffers, Hoffman & Niewyk

[57] ABSTRACT

The present invention is an improved lubrication system for a connecting rod, wrist pin, and piston of a compressor. An oil pump pumps lubricating oil upwardly within an axial bore of the crankshaft, which includes a radial passageway in alignment with the connecting rod. The connecting rod includes ports which direct pulses of oil onto the inner surfaces of the piston. The ports are separated by barrier segments to allow local oil pressure to build between the sequential alignments of the passageway and a port. Thus, pulses of oil are accurately sprayed onto the piston inner surfaces without substantially diminishing the lubrication of the journal bearings.

15 Claims, 3 Drawing Sheets

LUBRICATION SYSTEM OF CONNECTING ROD, PISTON, AND WRIST PIN FOR A COMPRESSOR

BACKGROUND

The present invention relates to refrigeration compressors. More specifically, the field of the invention is that of lubrication systems for the connecting rod, piston, and wrist pin of a hermetic compressor.

One problem of conventional compressors involves the piston-connecting rod assembly, and particularly the pistons, absorbing heat while compressing the refrigerant fluid. The residual heat of the piston can cause inefficiencies in the compression process and can lead to compressor failure. However, difficulty exists in cooling the connecting rods, wrist pins, and pistons because of the small amount of space available inside the compressor for cooling. Lubricating fluid is often used for the dual purpose of lubricating and cooling the crankcase assembly. However, the limited amount of space available for the lubrication system hinders its ability to satisfactorily cool the crankcase.

One prior art arrangement includes a connecting rod having a lubricating window for allowing lubricant to spray out of a passage of the crankshaft when aligned with the window. This arrangement causes a continuous oil spray toward the piston while the passage is aligned with the window. The crown of the piston absorbs the most heat, therefore cooling the crown is essential. Although the oil spray is aimed to impinge on the piston, often insufficient oil pressure causes some of the oil to miss the piston crown, hitting other less critical parts of the compressor. As cooling the crown of the piston and its associated parts is advantageous, the prior art lubrication systems for the connecting rod, wrist pin, and piston impair efficiency because they fail to reliably cool those critical parts.

What is needed is a lubrication system for the connecting rod, wrist pin, and piston which adequately cools while providing adequate lubrication for the compressor.

SUMMARY OF THE INVENTION

The present invention is a lubrication system for the connecting rod, wrist pin, and piston assembly of a compressor. The lubrication system includes means for spraying two pulses of lubricant onto the inner surfaces of the piston for cooling the piston assembly. The two ports in the connecting rod are structured to direct pulses of oil onto the inner surface of the piston when aligned with a radial passageway in the crankshaft.

The pulses of oil have a sufficiently high velocity to reliably reach the crown because the oil in the radial passageway is pressurized immediately before alignment with a port. Barrier segments of the connecting rod separate the ports, and may have a width greater than the width of the radial passageway. Thus, the local oil pressure increases between alignments of the ports and radial passageway, and the pressurized oil is intermittently and periodically pulse sprayed. Further, the lubricant directed onto the piston does not substantially diminish lubrication of the crankshaft bearings because the oil sprays out in short pulses rather than as a continuous stream of oil.

A third, central port is included which extends straight through the connecting rod to the wrist pin of the piston. The central port is located intermediate the first and second ports, with a barrier segment located on either side of the central port. Oil can spray out the central port, or the oil can be supplied to an annular groove and a radial hollow of the wrist pin for lubricating the wrist pin and its connections with the piston.

The piston assembly of the present invention includes crown and skirt portions which have inner surfaces. The inner surfaces allow the lubricant to penetrate to portions of the piston which absorb the heat generated by compressing the refrigerant. The improved access of lubricant to the heated portions of the piston in combination with the pulse spraying of the ports provides superior cooling of the piston assembly while maintaining adequate lubricant flow to the crankcase.

The present invention is, in one form, a compressor comprising a housing and a crankcase including a cylinder. The compressor includes means for circulating lubricant within the housing. A crankshaft is rotatably disposed in the housing, with the crankshaft having an eccentric portion. The crankshaft also includes an axial bore which is in fluid communication with the circulation means, and the eccentric portion includes a generally radial passageway in fluid communication with the axial bore. The compressor additionally has a piston for compressing and discharging refrigerant. The piston includes a crown portion, skirt portion, and wrist pin which are operably disposed in the cylinder, with the crown and skirt portions having inner surfaces. A connecting rod couples the piston and crankshaft. The connecting rod has an annular first end portion disposed about the eccentric portion of the crankshaft, a second end portion connected to the wrist pin, and an intermediate portion extending between and connecting the first and second end portions. Further, means is included for intermittently and periodically spraying a pulse of lubricant onto the piston, directing the pulses so that substantially all of the sprayed lubricant impinges on the inner surfaces of the piston. The pulse spray means comprises two ports in the first end portion facing the piston inner surfaces. The ports are disposed on mutually opposite sides of the connecting rod intermediate portion to align sequentially with the radial passageway during the rotation of the crankshaft.

One object of the present invention is to provide an improved lubrication system for the connecting rod, wrist pin, and piston of a compressor.

Another object is to provide a lubrication system which uses lubricant to absorb heat from the piston while not substantially reducing the lubrication of the compressor bearings.

Still another object is to provide a lubrication system which accurately delivers lubricant to the piston for cooling the piston and its associated parts.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
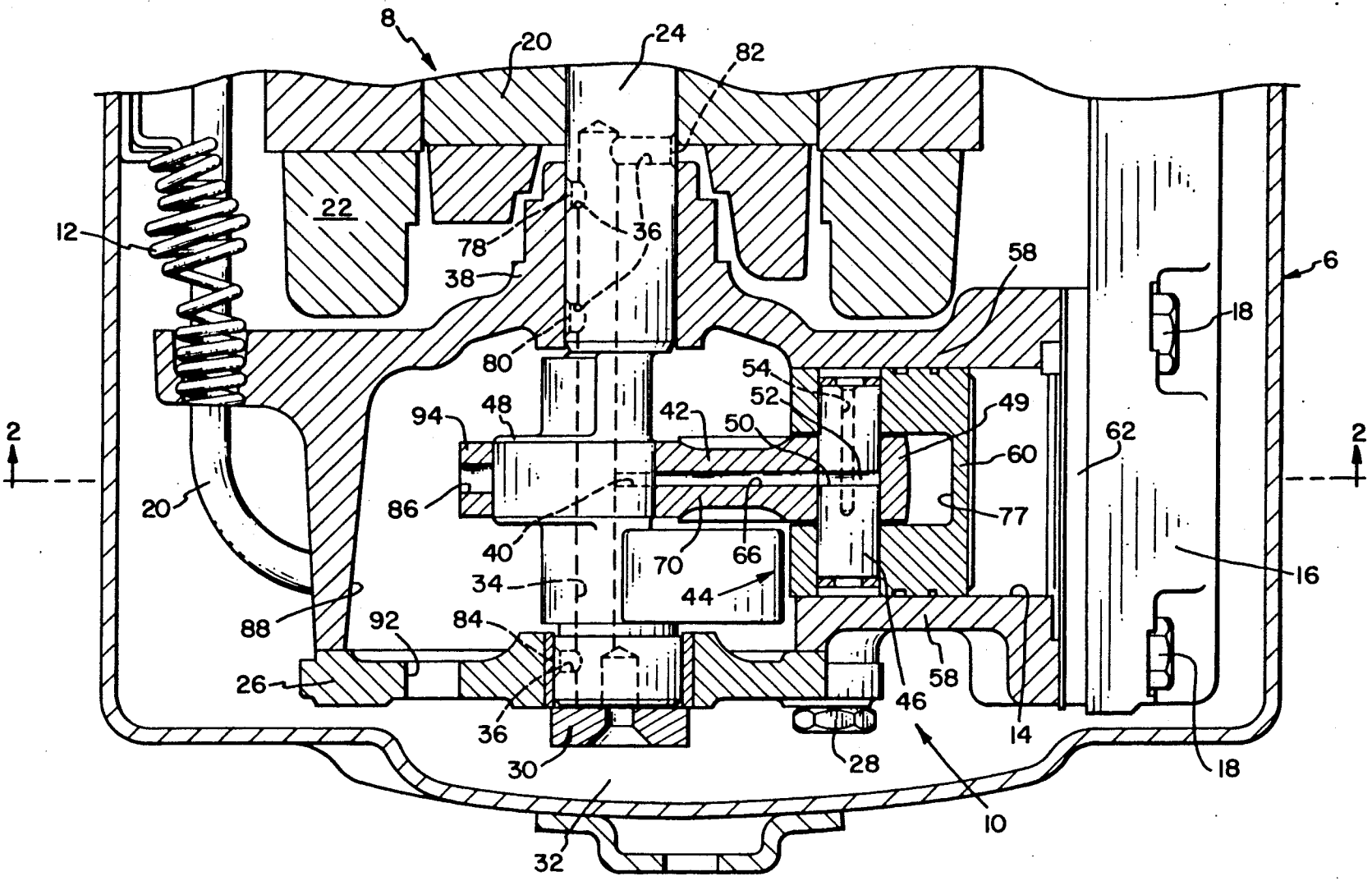
FIG. 1 is a side, fragmentary sectional view of the compressor of the present invention.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

Figure 2:
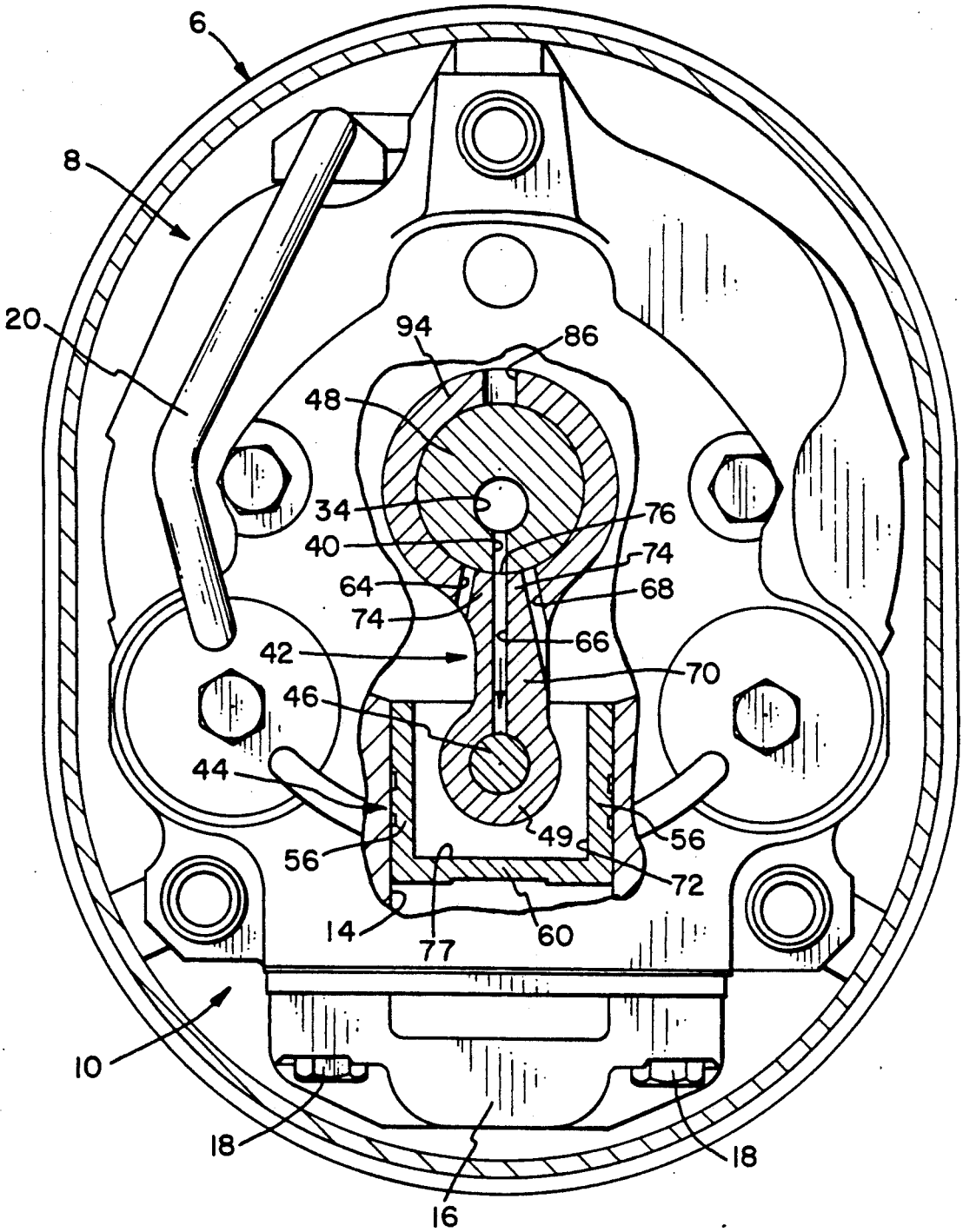
FIG. 2 is a bottom sectional view taken along line 2-2 of FIG. 1.

The compressor of the present invention is shown in FIGS. 1 and 2. Within a housing 6, which is hermetically sealed, a compressor motor 8 and a crankcase 10 are supported by three suspension springs 12. Crankcase 10 defines cylinder 14 where refrigerant is compressed, and has valve cover 16 connected by bolts 18. Refrigerant enters housing 6 at an inlet (not shown), is compressed in cylinder 14, and leaves via discharge line 20. Compressor motor 8 includes stator 20 and rotor 22, which is coupled to one end of crankshaft 24. The other end of crankshaft 24 extends through crankcase 10 and is received in outboard bearing 26, which is mounted on the underside of crankcase 10 by bolts 28.

Oil pump 30 is located at the lower end of crankshaft 24 in bearing 26, and extends into oil sump region 32. Oil pump 30 is a conventional impeller pump and pumps lubricating oil up through axial bore 34 of crankshaft 24. Radial oil ports 36 extend from axial bore 34 through crankshaft 24 to crankcase 10, providing lubrication to bearing 38 of crankcase 10 and bearing 26, respectively. Additionally, radial passageway 40 supplies oil to connecting rod 42, piston 44, and wrist pin 46 (FIG. 2).

An eccentric portion 48 of crankshaft 10 extends through one end 94 of connecting rod 42. The other end 49 of connecting rod 42 extends into cylinder 14 and engages wrist pin 46, which is connected to piston 44. Wrist pin 46 has an annular groove 50 in fluid communication with a radial hollow 52, and an axial passage 54 extending from radial hollow 52 to skirt portion 56 of piston 44. Skirt portion 56 abuts side walls 58 of cylinder 14, and crown portion 60 of piston 44 faces head 62 to compress refrigerant. As refrigerant is compressed, heat is generated which raises the temperature of the surrounding environment, particularly the crown portion 60 of piston 44.

In accordance with the present invention, connecting rod 42 includes three oil ports 64, 66, and 68 (FIG. 2). Central port 66 extends straight through intermediate portion 70 of connecting rod 42 to annual groove 50 of wrist pin 46. On opposite sides of port 66, ports 64 and 68 face inner surface 72 of piston 44. Preferably for smaller pistons 44, ports 64 and 68 are oriented at a 15° angle or less from central port 66, with the vertex of the angle being within axial bore 34. When aligned with radial passageway 40, a straight flow path is formed from axial bore 34 to inner surface 72. Because of the small angle, the exact point during the revolution of crankshaft 10 in which the alignment occurs is not crucial for proper functioning, although preferably, piston 44 is at its lowest point in cylinder 14 when passageway 40 sequentially aligns with ports 64, 66, and 68.

In a preferred embodiment of the present invention, barrier segments 74 are sections of connecting rod 42 which have a width greater than the width of radial passageway 40. Barrier segments 74 cause the accurate pulse spraying of lubricant by increasing the local oil pressure in passageway 40. Opening 76 of passageway 40 cannot span either barrier segment 74, and so for a period of time the local oil pressure builds because no oil outlet exists. When opening 76 aligns with either of the ports, the pressurized oil jets out of passageway 40 and spurts onto inner surface 72. Preferably a portion of the oil will impinge directly on the crown inner surface 77.

Figure 3:
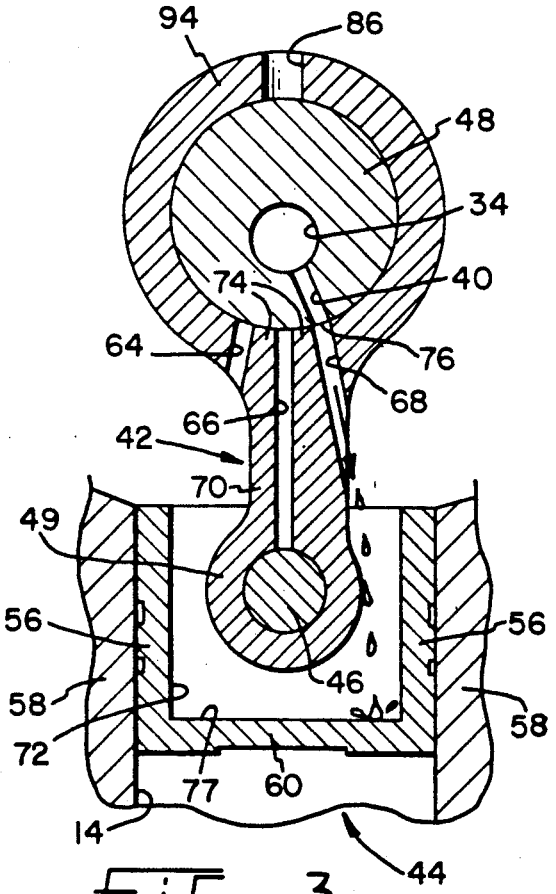
FIG. 3 is an enlarged sectional view of the connecting rod, piston, and wrist pin of FIG. 2 in a second orientation.
Figure 4:
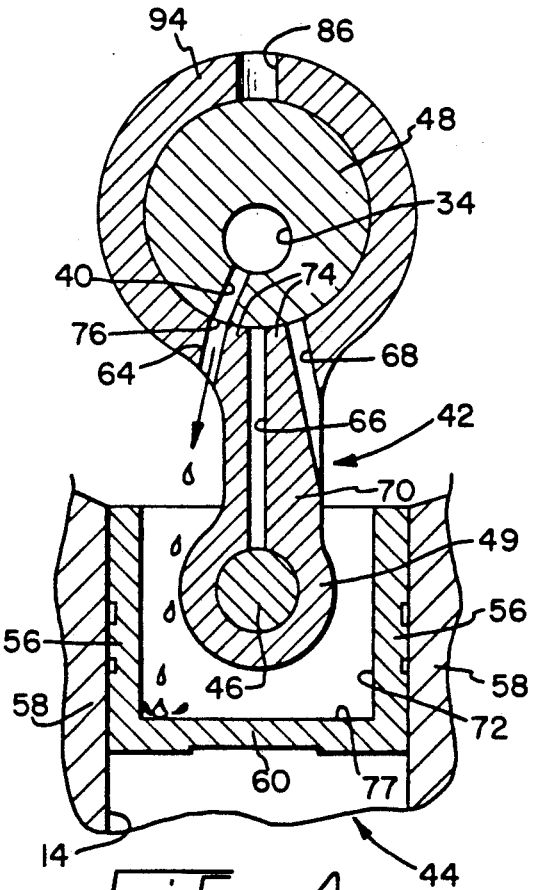
FIG. 4 is an enlarged sectional view of the connecting rod, piston, and wrist pin of FIG. 2 in a third orientation.

In operation, the rotation of crankshaft 24 drives oil pump 30, forcing lubricant up axial bore 34 to provide lubrication for bearing 38 at ports 78, 80, and 82 and also for bearing 26 at port 84. Referring to FIGS. 2, 3, and 4, a pulse of oil is expelled when radial passageway 40 aligns with one of the ports 64 or 68. In FIG. 2, passageway 40 is aligned with central port 66 and oil is pumped through intermediate portion 70 to wrist pin 46. In FIG. 3, passageway 40 is aligned with port 68 and oil is pumped onto one side of piston inner surface 72. In FIG. 4, the opposite port 64 is aligned and pumps oil to the other side of inner surface 72. When passageway 40 is aligned with access passage 86 (an orientation which is not shown), oil is sprayed onto interior wall 88 of crankcase 10. The oil in piston 44 and on interior wall 88 eventually flows down through drain opening 92 of crankcase 10 into oil sump 32. The oil is sprayed on inner surface 72 primarily for cooling piston 44, although some of the oil splashes onto other parts of connecting rod 42, piston 44, or wrist pin 46 and provides lubrication. The oil flowing around wrist pin 46 primarily lubricates, although some heat is dissipated by the flow of oil.

A preferred embodiment of the present invention provides for passage 40 and ports 64, 66, and 68 to be circular with a diameter in the range of 0.110 to 0.130 inches. However, for smaller diameters a greater velocity oil pulse results; and for larger diameters a greater volume oil pulse results. For any individual application, the diameter should be sized according to the desired velocity and volume of the oil pulse.

In addition, the angular orientations of ports 64 and 68, relative to center port 66, are approximately equal and measure in the range of 9° to 15°. The relative angle of the ports 64 and 68 is dependant on the size of access passage 86.

While this invention has been described as having a preferred design, it can be further modified within the teachings of this disclosure. This application is therefore intended to cover any variations, uses, or adaptations of the invention following its general principles. This application is also intended to cover departures from the present disclosure as come within known or customary practice in the art to which this invention pertains and which fall within the limits of the appended claims.

What is claimed is:

1. A compressor comprising:

a housing;

a crankcase including a cylinder;

circulation means for circulating lubricant within said housing;

a crankshaft rotatably disposed in said crankcase, said crankshaft having an eccentric portion, said crankshaft including an axial bore in fluid communication with said circulation means, said eccentric portion including a passageway in fluid communication with said axial bore;

a piston including a crown portion, a skirt portion, and a wrist pin operably disposed in said cylinder for compressing and discharging refrigerant, said piston crown and skirt portions each having an inner surface;

a connecting rod having a first end portion disposed about said eccentric portion of said crankshaft, a second end portion connected to said wrist pin of said piston, and an intermediate portion extending between and connecting said first and second end portions; and pulse spray means for intermittently and periodically spraying a pulse of lubricant directly onto said piston, said pulse spray means directing said pulses so that substantially all of the sprayed lubricant impinges on said inner surfaces of said piston, said pulse spray means including two ports in said connecting rod located in said first end portion and facing said inner surfaces of said piston, said ports disposed on mutually opposite sides of said connecting rod intermediate portion to align sequentially with said crankshaft passageway during the rotation of said crankshaft.

2. The compressor of claim 1 wherein said crankshaft passageway and said two ports are generally straight, and align colinearly at first and second angular orientations, respectively, of the rotation of said crankshaft.

3. The compressor of claim 1 wherein said connecting rod further includes a central port located intermediate said two ports.

4. The compressor of claim 3 wherein said central port and said crankshaft passageway are substantially straight, and are collinear when said radial passageway and said central port are aligned.

5. The compressor of claim 3 wherein each one of said two ports are positioned at an angular orientation of no more than 15° from said central port.

6. The compressor of claim 1 wherein said connecting rod further includes a central port located between said two ports, said central port extending through said intermediate portion from said first to said second end portion of said connecting rod and terminating at said wrist pin.

7. The compressor of claim 6 wherein said wrist pin includes an annular groove in alignment with said central port.

8. A compressor comprising:

a housing;

a crankcase including a cylinder;

circulation means for circulating lubricant within said housing;

a crankshaft rotatably disposed in said housing, said crankshaft having an eccentric portion, said crankshaft including an axial bore in fluid communication with said circulation means, said eccentric portion including a generally radial passageway in fluid communication with said axial bore;

a piston including a crown portion, a skirt portion, and a wrist pin operably disposed in said cylinder for compressing and discharging refrigerant, said piston crown and skirt portions each having an inner surface;

a connecting rod having an annular first end portion disposed about said eccentric portion of said crankshaft, a second end portion connected to said wrist pin of said piston, and an intermediate portion extending between and connecting said first and second end portions; and pulse spray means for intermittently and periodically spraying a pulse of lubricant onto said piston, said pulse spray means directing said pulses so that substantially all of the sprayed lubricant impinges on said inner surfaces of said piston, said pulse spray means including a first port and a second port in said connecting rod, said first and second ports located in said first end portion and facing said inner surfaces of said piston, and a segment of said first end portion positioned as a barrier between said first and second ports, said barrier segment having an arc length greater than the width of said radial passageway so that said radial passageway cannot simultaneously spray lubricant through said first port and said second port.

9. The compressor of claim 8 wherein said passageway and said ports are generally straight, and align colinearly at first and second angular orientations, respectively, in the rotation of said crankshaft.

10. The compressor of claim 8 wherein said connecting rod further includes a third port in said barrier segment located between said first and second ports.

11. The compressor of claim 10 wherein said third port and said passageway are substantially straight, and are collinear when said passageway and said third port are aligned.

12. The compressor of claim 10 wherein said first and second ports are positioned at an angular orientation of no more than 15° from said third port.

13. The compressor of claim 8 wherein said connecting rod further includes a third port in said barrier segment located between said first and second ports, said barrier segment comprising first and second sections adjacent to said third port, said third port extending through said intermediate portion from said first to said second end portion of said connecting rod and terminating at said wrist pin, said first section and said second section of said barrier segment each having an arc length greater than the width of said radial passageway so that said radial passageway cannot simultaneously spray lubricant through said first port and said third port, and cannot simultaneously spray lubricant through said second port and said third port.

14. The compressor of claim 8 wherein said connecting rod further includes a third port located between said first and second ports, said third port extending through said intermediate portion from said first end portion to said second end portion of said connecting rod and terminating at said wrist pin.

15. The compressor of claim 14 wherein said wrist pin includes an annular groove in alignment with said third port.

* * * * *